US006981389B2

(12) United States Patent
Knecht et al.

(10) Patent No.: US 6,981,389 B2
(45) **Date of Patent: *Jan. 3, 2006**

(54) RECEIVER AND SERVICE CARTRIDGE FOR A CONDENSER SYSTEM

(75) Inventors: John W. Knecht, Murfreesboro, TN (US); James D. Snow, Tullahoma, TN (US)

(73) Assignee: CalsonicKansei North America, Inc., Farmington Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/735,213

(22) Filed: Dec. 12, 2003

(65) Prior Publication Data

US 2005/0126214 A1 Jun. 16, 2005

(51) Int. Cl.
*F25B 43/00* (2006.01)
*F25B 39/04* (2006.01)

(52) U.S. Cl. ..... 62/474; 509/512

(58) Field of Classification Search ..... 62/474, 62/509, 512, 473, 503, 298, 77; 165/110, 165/132

See application file for complete search history.

(56) References Cited

U.S. PATENT DOCUMENTS 5,228,315 A 7/1993 Nagasaka et al.
5,375,327 A 12/1994 Searfoss et al.
5,395,509 A * 3/1995 Guerra Cisneros et al. ... 210/91
5,505,253 A 4/1996 Heraud
5,522,204 A 6/1996 Wood
5,529,203 A 6/1996 Flaugher
5,537,839 A 7/1996 Burk et al.
5,540,348 A 7/1996 Wood
5,546,761 A 8/1996 Matsuo et al.
5,569,316 A 10/1996 Flaugher et al.
5,580,451 A 12/1996 Tack
5,666,791 A 9/1997 Burk
5,685,087 A 11/1997 Flaugher et al.
5,713,217 A 2/1998 Baba
5,716,432 A 2/1998 Perrine
5,814,136 A 9/1998 Wood
5,837,039 A 11/1998 LeConey et al.
5,868,002 A 2/1999 Matsubayashi
5,914,456 A 6/1999 LeConey et al.
5,927,102 A 7/1999 Matsuo et al.
5,934,102 A 8/1999 DeKeuster et al.
5,946,940 A 9/1999 Inoue
6,170,287 B1 1/2001 Leitch et al.
6,223,556 B1 * 5/2001 De Keuster et al. ..... 62/509
6,260,379 B1 7/2001 Manwill et al.

(Continued)

*Primary Examiner*—Chen Wen Jiang
(74) *Attorney, Agent, or Firm*—Jordan M. Meschkow; Lowell W. Gresham; Meschkow & Gresham, P.L.C.

(57) ABSTRACT

A receiver (24) for a condenser system (20) includes a body (32) in fluid communication with a header (28) of the condenser system (20). A first cap (38) is coupled to an end (34) of the body (32) and has a saddle portion (40) coupled to the header (28). The receiver (24) further includes a tube section (42) coupled to a second end (36) of the body. A second cap (50) is removably interconnected with the tube section (42) following insertion of a service cartridge (76) into the body (32). The service cartridge (76) includes a substantially-rigid tubular member (78) having rib members (84) radially extending from an outer surface (86) of the tubular member (78). Covers (90, 92), each having openings (94, 96), are coupled to opposing ends of the tubular member (78). The service cartridge (76) includes multiple features for drying, filtering, and/or leak detection.

24 Claims, 5 Drawing Sheets

U.S. PATENT DOCUMENTS 6,295,832 B1 10/2001 Kato et al.
6,395,074 B1 5/2002 Mastromatteo
6,470,704 B2 10/2002 Shibata et al.
6,474,098 B2 11/2002 Perrine et al.
6,616,737 B1 9/2003 Evans et al.
6,623,549 B1 9/2003 Evans et al.
2003/0085026 A1 5/2003 Kaspar et al.
2004/0025532 A1 * 2/2004 Scaringe et al. ..... 62/474

* cited by examiner

RECEIVER AND SERVICE CARTRIDGE FOR A CONDENSER SYSTEM

TECHNICAL FIELD OF THE INVENTION

The present invention relates to the field of air conditioning systems. More specifically, the present invention relates to a serviceable receiver for a condenser in an air conditioning system and a service cartridge for the serviceable receiver.

BACKGROUND OF THE INVENTION

In a conventional vapor compression system, vapor refrigerant is compressed in the compressor, where its temperature is raised above the temperature of the cooling medium used at the condenser. A mixture of vapor and liquid refrigerant then enters the condenser where heat is extracted, and the refrigerant changes to a liquid. The liquid refrigerant enters the thermal expansion valve, which controls the quantity of liquid refrigerant passing to the evaporator coils. Finally, the liquid refrigerant enters the evaporator and evaporates. Heat from the ambient atmosphere, for example, in a vehicle passenger compartment, is rejected to the refrigerant in the evaporator where it is absorbed as the latent heat of vaporization as the refrigerant evaporates. The now vaporized refrigerant is then directed to the compressor to be recycled through the system.

Some vapor compression systems include a receiver which is intended to perform some or all of the following functions: filtration and/or dehydration of the refrigerant, compensation for variations in its volume, and separation of the vapor and liquid phases of the refrigerant. Typically, an inlet pipe is coupled between an upstream section of the condenser and an inlet aperture of the receiver for carrying the vapor and liquid phases of the refrigerant to the receiver. An outlet pipe is coupled between an outlet aperture of the receiver and a downstream section of the condenser header for returning the liquid phase of the refrigerant to the downstream section. Interposing the receiver between upstream and downstream sections of the condenser ensures the fluid in the downstream section circulates only in the liquid state. The downstream section, or sub-cooler section, of the condenser sub-cools the liquid refrigerant to a point below the temperature at which the liquid changes to a gas. The sub-cooled liquid phase refrigerant quality is low and its enthalpy is also low which increases the evaporator's ability to absorb heat as the refrigerant evaporates, thus improving the efficiency of the vapor compression system.

Condenser systems used in vehicle air conditioning systems are typically manufactured by first assembling brazing clad condenser components, then passing the assembled components through a brazing furnace to braze, or fuse, the components together. Generally, one or more brackets and fasteners are used to mount the receiver, inlet pipe, and outlet pipe to a header of the condenser. The bracket or brackets may also be coupled to the header during the brazing process. The receiver is then coupled to a condenser header during a post-braze assembly process.

Post-braze assembly is typically performed manually, thus resulting in undesirably high labor costs. In addition, a high number of discrete components burdens those responsible for inventory control, increases the likelihood that the condenser system may be incorrectly assembled, and increases the potential for damaging the condenser system and/or receiver during post-braze assembly.

It is known to utilize desiccants to remove moisture from the refrigerant, filters to remove particulates, tracer dyes for leak detection, and the like in receivers. These additional enhancements are inserted into the receiver during post-braze assembly. The problems of undesirably high labor costs, inventory control, incorrect assembly, and potential for damage are exacerbated in receivers that utilize these additional discrete elements.

In order to mitigate some of the problems associated with post-braze assembly, some prior art receivers are coupled to the condenser header during the brazing process, thus yielding an integrated condenser with receiver. Unfortunately, difficulties have arisen in the development of desiccants, desiccant bags, filter materials, and dye materials that can withstand the heat of the brazing process. Consequently, many of these receivers do not include those enhancements.

Alternatively, some prior art integrated receivers require a portion of the receiver to be removable for installation of the desiccant and/or filter after the condenser with integrated receiver is brazed. After the desiccant and/or filter is installed in the receiver dryer, the receiver can then be permanently closed by welding a cap on one end. Alternatively, additional fasteners can be used for post-brazing assembly, as well as O-rings for sealing the receiver. Again, problems arise with a high number of discrete components, undesirably high labor costs, and so forth.

Regardless of the type of receiver employed (whether it's coupled to the condenser header during post-braze assembly or during the brazing process), it is desirable to have the capability of replacing desiccant bags, filters, and/or dyes in the receiver during routine condenser maintenance. Unfortunately, once installed into an automobile it is often difficult and even impossible to access the receiver due to the vehicle envelope and interference of surrounding components.

Thus, what is needed is a receiver for a condenser that calls for limited post-braze assembly and is readily serviceable. In addition, what is needed is an apparatus that combines multiple features such as, drying, filtering, and leak detection for ready installation into the receiver.

SUMMARY OF THE INVENTION

Accordingly, it is an advantage of the present invention that a receiver for a condenser is provided.

It is another advantage of the present invention that a serviceable receiver is provided that requires limited post-braze assembly and is readily serviceable.

Another advantage of the present invention is that a service cartridge is provided that is readily installable into the receiver.

Yet another advantage of the present invention is that a service cartridge is provided for the receiver that can include multiple user-specified features for drying, filtering, and leak detection.

The above and other advantages of the present invention are carried out in one form by a receiver for a condenser system, the condenser system including two spaced apart headers. The receiver includes a body configured for fluid communication with one of the spaced apart headers, the body having first and second ends. A first cap is coupled to the body at the first end and has a first saddle portion adapted for coupling to the one of the spaced apart headers. A tube section is coupled to the body at the second end. A service cartridge is inserted through the tube section into an interior cavity of the body, and a second cap is removably interconnected with the tube section following insertion of the service cartridge into the interior cavity.

The above and other advantages of the present invention are carried out in another form by a service cartridge for a receiver in a condenser system. The receiver has a body configured for fluid communication with a header of the condenser system. The receiver further has a removably attachable cap for accessing an interior cavity of the body, the service cartridge being insertable into the interior cavity. The service cartridge includes a substantially-rigid tubular member having first and second ends and rib members radially extending from an outer surface of the substantially-rigid tubular member and configured to abut an inner surface of the body. A first cover is coupled to the first end and has a first opening extending through the first cover for receiving a refrigerant. A second cover is coupled to the second end and has a second opening extending through the cover for discharging the refrigerant.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
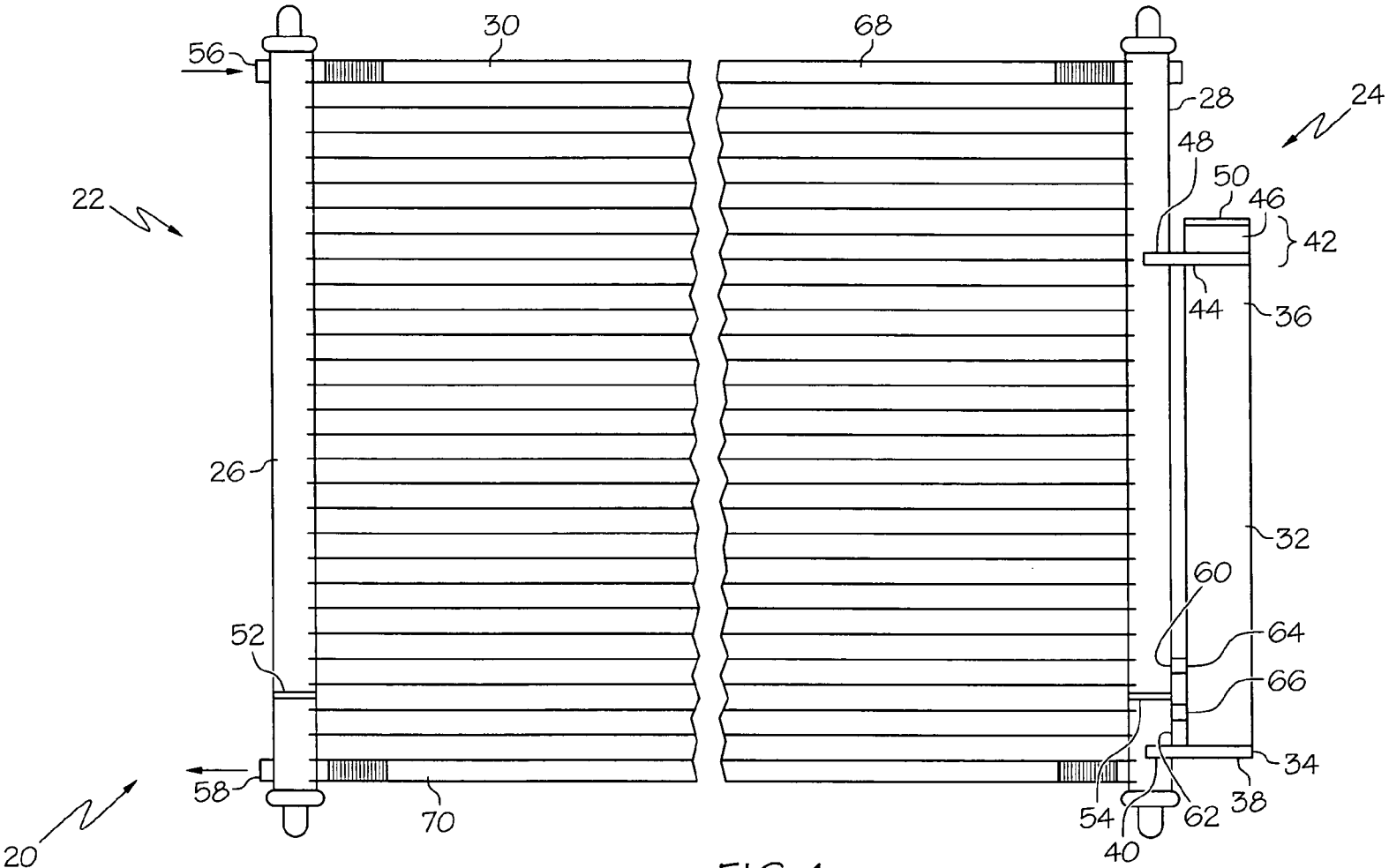
FIG. 1 shows a front view of a condenser system for a vapor compression system.

FIG. 1 shows a front view of a condenser system 20 for a vapor compression system (not shown). In an exemplary embodiment, the vapor compression system may be a vehicle air conditioning system known to those skilled in the art for cooling the passenger compartment of a vehicle. Condenser system 20 includes a condenser, generally designated 22, and a receiver, generally designated 24. Condenser 22 includes a pair of tubular, parallel headers, generally designated as a first header 26 and a second header 28. Parallel tubes 30 extend between first and second headers 26 and 28, respectively, for passing refrigerant between first and second headers 26 and 28.

Figure 2:
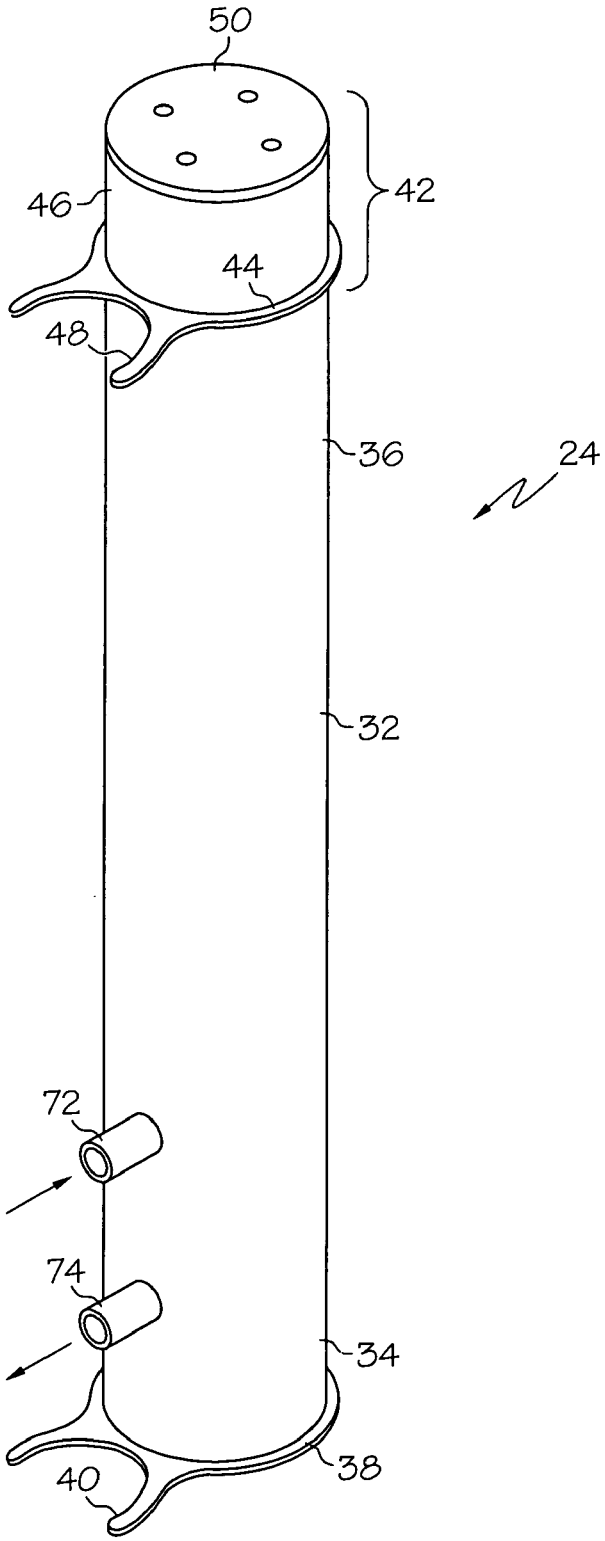
FIG. 2 shows a perspective view of a receiver for the condenser system of FIG. 1 in accordance with a preferred embodiment of the present invention.

Referring to FIG. 2 in connection with FIG. 1, FIG. 2 shows a perspective view of receiver 24 for condenser system 20 in accordance with a preferred embodiment of the present invention. Receiver 24 includes a body 32 having a first end 34 and a second end 36. A first cap 38 is nondetachably coupled to first end 34 of body 32, and a first saddle portion 40 of first cap 38 is affixed to second header 28.

A tube section 42 of receiver 24 is coupled to second end 36 of body 32. Tube section 42 includes a header interface 44 coupled to second end 36 of body 32 and a tubular collar 46 coupled to header interface 44. Header interface 44 includes a second saddle portion 48 affixed to second header 28. A second cap 50 is removably interconnected with tubular collar element 46 of tube section 42. Second cap 50 is removable so that an interior of body 32 can be accessed for installation and/or replacement of a service cartridge, discussed below.

Although tube section 42 is described in terms of two elements, i.e., header interface 44 and tubular collar 46, those skilled in the art will recognize that these two elements can be readily adapted into a single element having the combined functions of header interface 44 and tubular collar 46. In addition, it should be understood that receiver 24 may be readily modified so that the combined components of tube section 42 and second cap 50 may exchange positions with first cap 38. This adaptation can be readily accomplished to accommodate servicing of receiver 24 from below rather than above.

In an exemplary embodiment, condenser 22 is a two pass condenser. As such, first header 26 includes an imperforate wall 52 extending through first header 26. Similarly, second header 28 includes an imperforate wall 54 extending through second header 28. First header 26 includes an inlet opening 56 above imperforate wall 52 for receiving a mixture of vapor and liquid phase refrigerant from a compressor (not shown) of the vehicle air conditioning system (not shown). Below imperforate wall 52, first header 26 includes an outlet opening 58 for directing liquid phase refrigerant from condenser 22 toward the evaporator (not shown) of the vehicle air conditioning system.

Second header 28 includes a header outlet port 60 above imperforate wall 54 and a header inlet port 62 below imperforate wall 54. An inlet aperture 64 of receiver 24 is in fluid communication with header outlet port 60 and an outlet aperture 66 of receiver 24 is in fluid communication with header inlet port 62.

In general, vapor and liquid phase refrigerant enters condenser system 20 at inlet 56 of first header 26. The refrigerant may be distributed by first header 26 to tubes 30 that are above imperforate wall 52, referred to generally as an upstream section 68, to flow to second header 28. Once the vapor and liquid phase refrigerant enters second header 28, it is routed to receiver 24 via header outlet port 60 through inlet aperture 64.

Receiver 24 serves to separate the liquid phase refrigerant from the vapor phase refrigerant. After the liquid phase refrigerant and the vapor phase refrigerant are separated within receiver 24, liquid refrigerant enters second header 28 via outlet aperture 66 of receiver 24 through header inlet port 62. The liquid refrigerant is subsequently routed to tubes 30 below imperforate wall 54, referred to generally as a downstream section 70.

Downstream section 70, known as a sub-cooler section, of condenser system 20 sub-cools the liquid refrigerant to a point below the temperature at which the liquid changes to a gas. The sub-cooled liquid phase refrigerant increases the ability of the evaporator (not shown) of the vehicle air conditioning system to absorb heat as the refrigerant evaporates, thus improving the efficiency of the system. Following sub-cooling in downstream section 70, the liquid refrigerant passes to first header 26 below imperforate wall 52 and exits from outlet opening 58 for eventual receipt at the evaporator (not shown) of the vehicle air conditioning system (not shown).

Condenser system 20 is described as being a two pass condenser for illustrative purposes. However, it should be understood that the present invention is not limited to two pass condensers. Rather, the present invention may be adapted for use with two or more pass condenser systems in which a receiver is employed to separate the liquid phase refrigerant from the vapor phase refrigerant between passes.

Condenser system 20 is manufactured using a one-shot, or single, brazing process. That is, the components of condenser system 20, including receiver 24 with body 32, first cap 38, and tube section 42, are first assembled together. The entire assembly is then passed through a brazing furnace to braze, or fuse, the components together. Through brazing, strong, uniform, leak-proof joints are formed. Following the brazing process, limited post-braze assembly calls for the installation of a service cartridge (discussed below) and the attachment of second cap 50. The design of receiver 24 advantageously causes first cap 38 and tube section 42 (i.e., header interface 44 and tubular collar 46) to fuse, i.e., nondetachably couple, to body 32, during the same process that causes first and second saddle portions 40 and 48, respectively, to fuse, i.e., nondetachably couple, to second header 28.

In addition, a first stamped/clad pipe 72 may be installed in inlet aperture 64 and a second stamped/clad pipe 74 may be installed in outlet aperture 66. First and second pipes 72 and 74, respectively, are installed through inlet and outlet apertures 64 and 66, respectively, prior to the brazing process. Accordingly, pipes 72 and 74 also fuse to each of body 32 and second header 28 during the brazing process.

Alternatively, inlet aperture 64 and outlet aperture 66 may be extruded openings. To form an extruded opening, a pilot hole is produced in receiver 24. The material around the pilot hole is formed outward to produce a collar around the hole. This collar provides support in a lap joint or butt weld connection when faced. The collars at each of inlet and outlet apertures 64 and 66, respectively, fuse to second header 28 about header outlet port 60 and header inlet port 62 during the one-shot brazing process. The nondetachable coupling of the collars to second header 28 during the one-shot brazing process provides secure interconnection of inlet aperture 64 with header outlet port 60, and outlet aperture 66 with header inlet port 62. In addition, this coupling during brazing eliminates the need for any post-brazing assembly of additional pipes, fasteners, and so forth between second header 28 and receiver 24.

Figure 3:
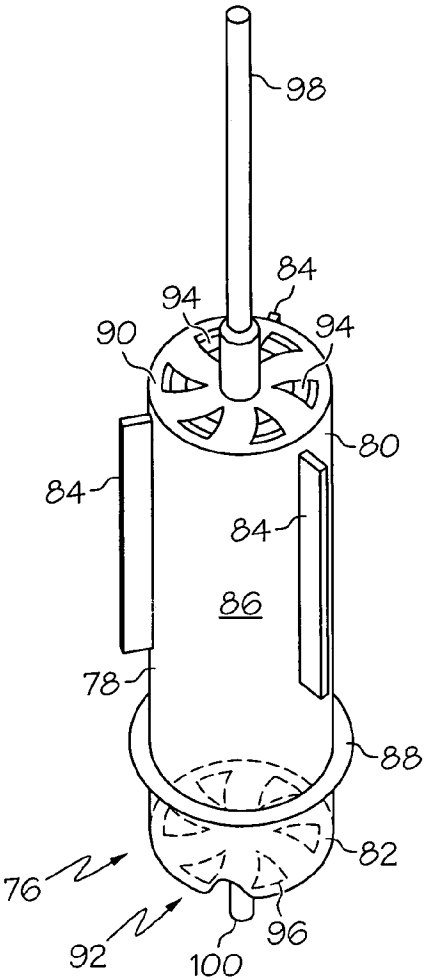
FIG. 3 shows a perspective view of a service cartridge utilized with the receiver of FIG. 2.

FIG. 3 shows a perspective view of a service cartridge 76 utilized with receiver 24 (FIG. 2). As mentioned briefly above, service cartridge 76 is configured to reside in an interior cavity of body 32 (FIG. 2) of receiver 24 (FIG. 2). Service cartridge 76 advantageously includes user-specified features for drying, filtering, and leak detection in a single, readily installed unit.

Service cartridge 76 includes a substantially-rigid tubular member 78 having a third end 80 and a fourth end 82. Service cartridge 76 further includes rib members 84 radially projecting from an outer surface 86 of tubular member 78. In addition, separating means, in the form of a sleeve 88 or V-seal is coupled about outer surface 86.

A first cover 90 is coupled to third end 80 and a second cover 92 is coupled to fourth end 82. First openings 94 extend through first cover 90 for receiving refrigerant, discussed below. Similarly, second openings 96 extend through second cover 92 for discharging refrigerant, also discussed below. A first spindle 98 extends from first cover 90, and a shorter, second spindle 100 extends from second cover 92. As will be discussed below, first and second spindles 98 and 100, respectively, facilitate rapid installation and positioning of service cartridge 76 into body 32 (FIG. 2) and removal of service cartridge 76 from body 32.

In an exemplary embodiment service cartridge is an extruded, molded, or fabricated plastic material. Such materials are cost effectively produced, lightweight, and durable. Those skilled in the art will recognize that other materials, such as aluminum, may alternatively be employed for the production of service cartridge 76.

Figure 4:
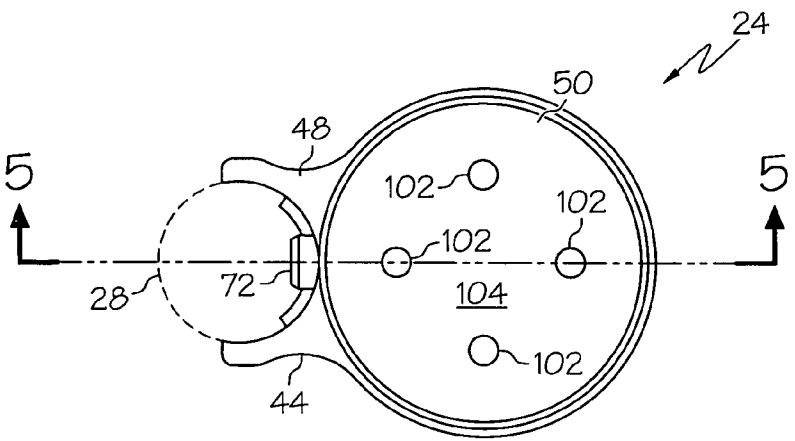
FIG. 4 shows a top view of the receiver of FIG. 2.

FIG. 4 shows a top view of receiver 24. FIG. 4 particularly illustrates holes 102 inwardly extending from an outer surface 104 of second cap 50. Second cap 50 is a threaded cap that can be removably interconnected with corresponding threads of tubular collar 46 (FIG. 2) of tube section 42 (FIG. 2). Holes 102 enable the application of a conventional prong wrench (not shown) to effect angular adjustment of second cap 50. That is, the prongs of the prong wrench are inserted into holes 102 of second cap 50 and torque is applied via the prong wrench to either tighten or loosen second cap 50 relative to tubular collar 46. Although four holes 102 are shown for interfacing with a four prong wrench, it should be readily apparent that second cap 50 may have a different quantity of holes 102 for interfacing with a prong wrench having a different quantity of prongs.

Figure 5:
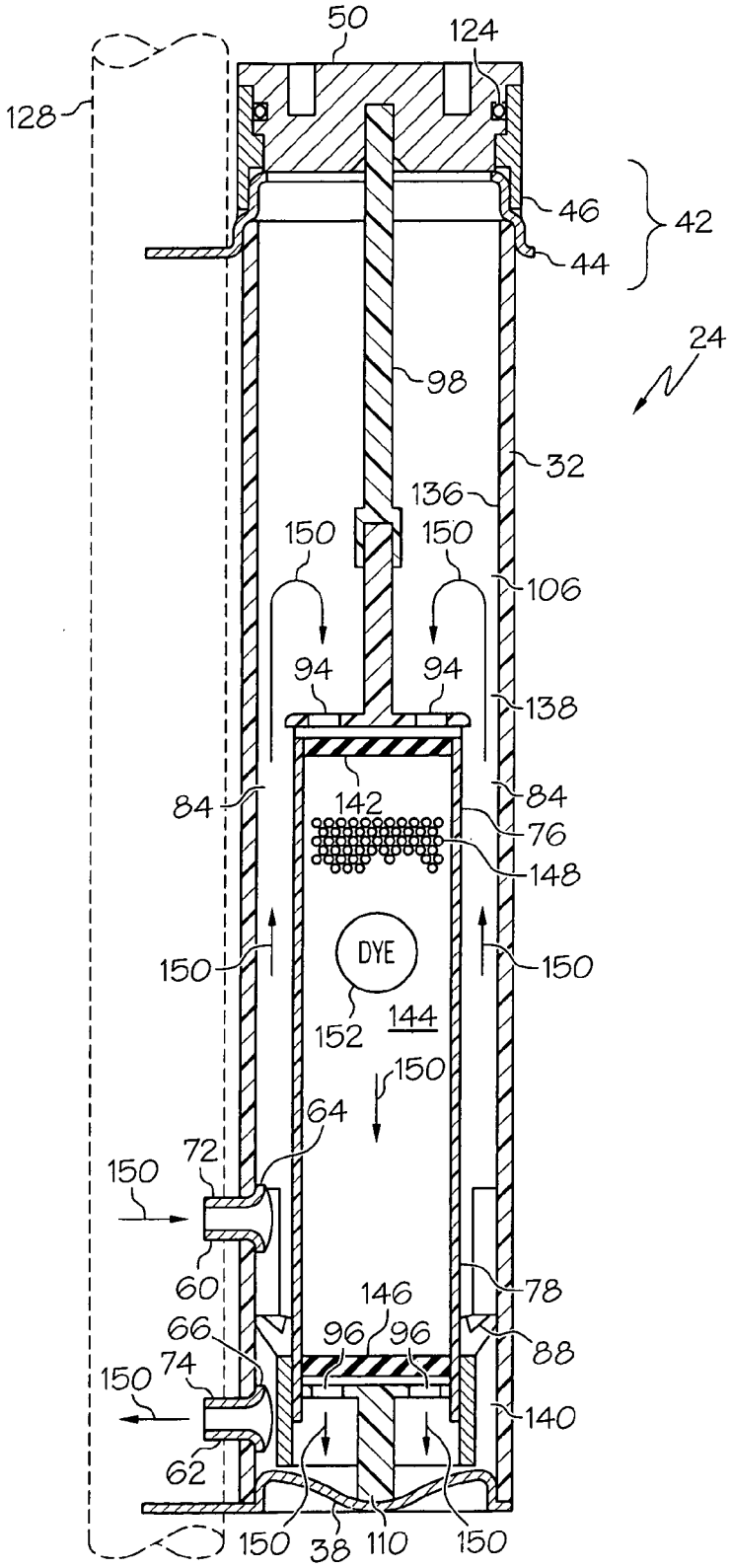
FIG. 5 shows a side sectional view of the receiver along section line 5—5 of FIG. 4.
Figure 6:
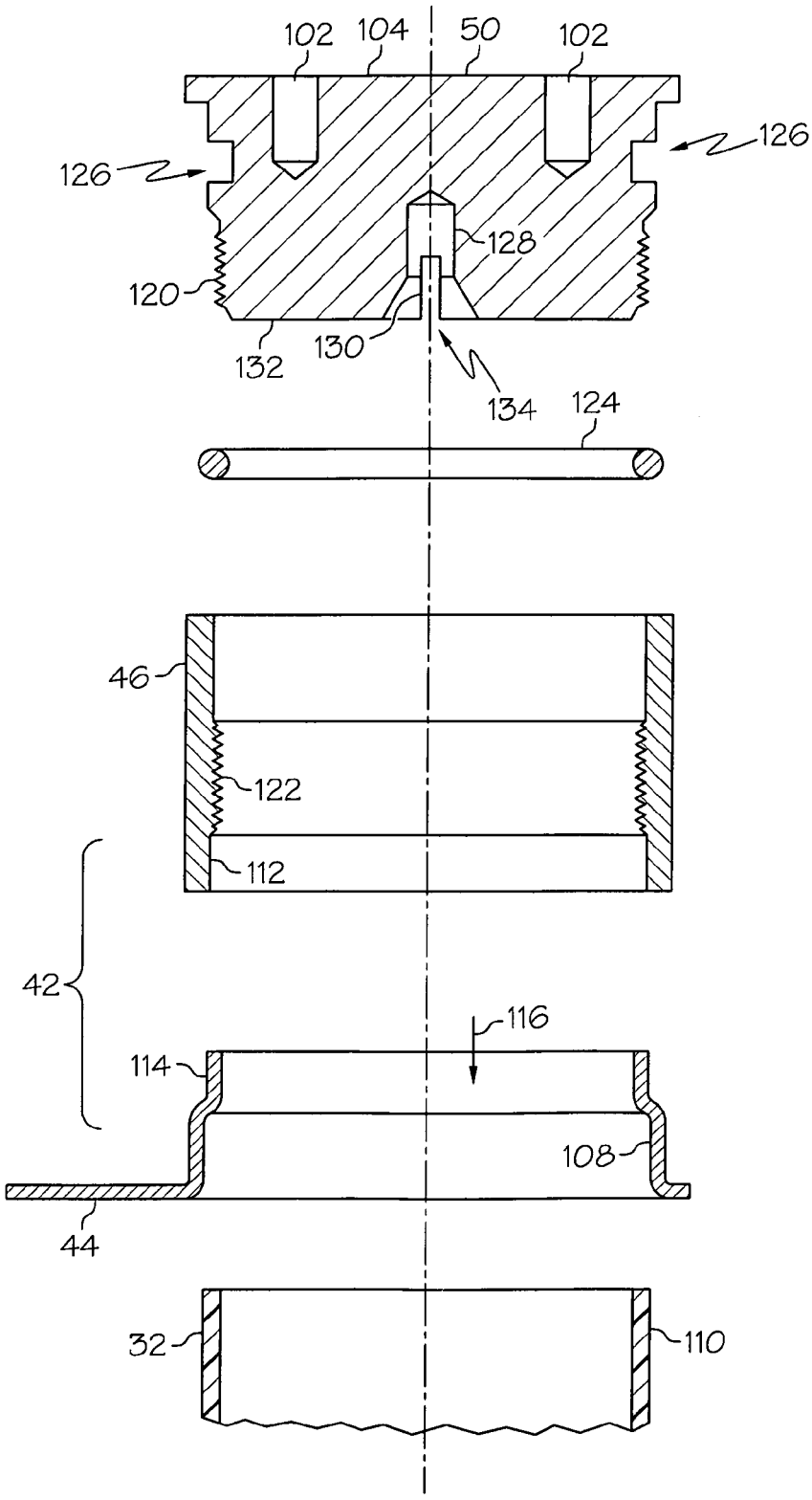
FIG. 6 shows an exploded side sectional view of a portion of the receiver.

Referring to FIGS. 5–6, FIG. 5 shows a side sectional view of receiver 24 along section line 5—5 of FIG. 4. FIG. 6 shows an exploded side sectional view of a portion of receiver 24. FIG. 5 particularly illustrates service cartridge 76 inserted into an interior cavity 106 of body 32.

At brazing, an interior surface 108 of header interface 44 overlaps and fuses to an outside 110 of body 32. In addition, an interior region 112 of tubular collar 46 fuses to an exterior surface 114 of header interface 44 about a central opening 116 in header interface 44. Following the brazing process, service cartridge 76 may be inserted through tube section 42, i.e., through central opening 116 of header interface 44, into interior cavity 106 of body 32.

Service cartridge is slid into body 32 until second spindle 100 abuts first cap 38. Threads 120 of second cap 50 are then engaged with corresponding threads 122 of tubular collar 46. As shown, an optional O-ring 124 may be utilized to enhance the sealing capabilities between second cap 50 and tubular collar 46. Second cap 50 is furnished with a groove portion 126 into which O-ring 124 may be seated prior to second cap 50 being coupled to tubular collar 46.

Second cap 50 further includes a socket 128. Socket 128 includes a flared region 130 at an inward surface 132 of second cap 50. Flared region 130 functions to guide first spindle 98 into socket 26 when second cap 50 is being coupled to tubular collar 46. First and second spindles 98 and 100, respectively, help to retain service cartridge 76 in a relatively centered position within body 32. In addition, should service cartridge 76 need to be replaced, first spindle 98 can be readily grasped and service cartridge 76 can be pulled from receiver 24. It should be noted that first spindle 98 is significantly longer than second spindle 100. This causes tubular member 78 of service cartridge to reside lower in body 32, and leaves some headspace in body 32 for the vapor phase refrigerant.

Second cap 50 further includes a slot 134 in inward surface 132 into second cap 50. The contents of receiver 24 are under pressure. Thus, when second cap 50 is loosened from tubular collar 46, slot 134 provides a pathway for pressure relief for body 32 while threads 120 of second cap 50 are still engaged with threads 122 of tubular collar 46. Accordingly, pressure is released in a controlled manner to largely prevent opening under pressure, and the resulting potential for equipment damage and/or injury.

Once service cartridge 76 is installed into interior cavity 106, rib members 84 projecting from outer surface 86 of service cartridge 76 abut an inner surface 136 of body 32. Rib members 84 substantially prevent service cartridge 76 from rattling in body 32. Sleeve 88, extending from outer surface 86 of service cartridge, also abuts inner surface 136.

Thus, sleeve 88 effectively splits interior cavity 106 into a first chamber 138 and a second chamber 140, with inlet aperture 64 extending through body 32 into first chamber 138 and with outlet aperture 66 extending through body 32 into second chamber 140.

In a preferred embodiment, a first filter 142 is positioned in an interior 144 of service cartridge 76 proximate third end 80. A second filter 146 is positioned in interior 144 proximate fourth end 82. Service cartridge 76 further includes a desiccant 148 interposed between first and second filters 142 and 146, respectively. Service cartridge 76 may further comprises a tracer dye 148 utilized for leak detection. Although a preferred embodiment of the contents of service cartridge 76 is described above, a different arrangement of features may be provided with service cartridge 76. For example, a service cartridge could include more or less than two filters, and/or it may or may not contain desiccant and tracer dye. The structure of service cartridge 76 advantageously enables a combination of desired features in a single housing for rapid, cost effective installation and replacement.

In operation, the vapor and liquid phases of the refrigerant, represented by an arrow 150, exit second header 128 via header outlet port 60 and enter first chamber 138 of receiver 24 via inlet aperture 64. Refrigerant 150 enters service cartridge 76 via first openings 94. In particular, the liquid phase of refrigerant 150 enters service cartridge 76 via first openings 94. Refrigerant 150 is subsequently filtered at first filter 142 and moisture is drawn from refrigerant 150 as it flows through desiccant 148. The liquid phase refrigerant 150 is filtered again at second filter 146 to remove any desiccant particulate contaminants. The dual filtration system of service cartridge 76 enables the use of small diameter filters in the tubular structure of cartridge 76, while providing highly efficient filtration.

Refrigerant 150 subsequently exits service cartridge 76 via second openings 96 and is discharged into second chamber 140. The liquid phase refrigerant 150 is directed back to second header 28 via outlet aperture 66, and enters second header 28 through header inlet port 62. Tracer dye 152 from service cartridge 76 combines with refrigerant 150, and is also directed into second header 28.

In summary, the present invention teaches of a receiver for a condenser. A majority of the receiver is integrated with the condenser during a one-shot brazing process to form a condenser system. Limited post-braze assembly merely entails the installation of a service cartridge and interconnection of a cap. The service cartridge is easily installed and removed from the receiver utilizing the spindle structure. In addition, the service cartridge can include a combination of filters, desiccant, and tracer dye per system requirements.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A receiver for a condenser system, said condenser system including two spaced apart headers, and said receiver comprising:

a body configured for fluid communication with one of said spaced apart headers, said body having first and second ends;

a first cap coupled to said body at said first end and having a first saddle portion adapted for coupling to said one of said spaced apart headers;

a tube section coupled to said body at said second end;

a service cartridge being inserted through said tube section into an interior cavity of said body; and a second cap removably interconnected with said tube section following insertion of said service cartridge into said interior cavity, said second cap including a slot in an inward surface of said second cap, said slot providing a pathway for pressure relief when said second cap is disconnected from said tube section.

2. A receiver as claimed in claim 1 wherein said first cap and said tube section are nondetachably coupled to said body.

3. A receiver as claimed in claim 1 wherein said tube section includes a second saddle portion adapted for coupling to said one of said spaced apart headers.

4. A receiver as claimed in claim 1 wherein said tube section includes a threaded region for mating engagement with a corresponding threaded portion of said second cap.

5. A receiver as claimed in claim 1 wherein said second cap comprises holes inwardly extending from an outer surface of said second cap, said holes enabling application of a prong wrench to effect angular adjustment of said second cap.

6. A receiver as claimed in claim 1 further comprising:

means for separating said body of said receiver into a first chamber and a second chamber;

an inlet aperture extending through said body into said first chamber for directing a refrigerant from a first portion of said one of said headers into said first chamber; and an outlet aperture extending through said body into said second chamber for directing said refrigerant from said second chamber to a second portion of said one of said headers.

7. A receiver as claimed in claim 6 wherein said separating means comprises a sleeve coupled about said service cartridge and extending from an outer surface of said service cartridge to an inner surface of said body.

8. A receiver as claimed in claim 6 wherein said service cartridge comprises a first opening positioned in said first chamber and a second opening positioned in said second chamber, said refrigerant from said first chamber entering said service cartridge through said first opening and exiting said service cartridge through said second opening.

9. A receiver for a condenser system, said condenser system including two spaced apart headers, and said receiver comprising:

a body configured for fluid communication with one of said spaced apart headers, said body having first and second ends;

a first cap coupled to said body at said first end and having a first saddle portion adapted for coupling to said one of said spaced apart headers;

a tube section coupled to said body at said second end;

a service cartridge being inserted through said tube section into an interior cavity of said body; and a second cap removably interconnected with said tube section following insertion of said service cartridge into said interior cavity;

a header interface coupled to said body at said second end and adapted for non-detachable coupling to said one of said spaced apart headers, said header interface having a central opening; and a tubular collar having an interior region coupled to an exterior surface of said header interface about said central opening, and said second cap being removably interconnected with said tubular collar.

10. A receiver for a condenser system, said condenser system including two spaced apart headers, and said receiver comprising:

a body configured for fluid communication with one of said spaced apart headers, said body having first and second ends;

a first cap coupled to said body at said first end and having a first saddle portion adapted for coupling to said one of said spaced apart headers;

a tube section coupled to said body at said second end;

a service cartridge being inserted through said tube section into an interior cavity of said body, said service cartridge including:

a substantially-rigid tubular member having third and fourth ends;

a first cover at said third end and having a first opening extending through said first cover for receiving a refrigerant; and a second cover at said fourth end and having a second opening extending through said second cover for discharging said refrigerant; and a second cap removably interconnected with said tube section following insertion of said service cartridge into said interior cavity.

11. A receiver as claimed in claim 10 wherein said service cartridge further comprises rib members radially projecting from an outer surface of said substantially-rigid tubular member to abut an inner surface of said body.

12. A receiver as claimed in claim 10 wherein said service cartridge comprises:

a first filter positioned in an interior of said service cartridge proximate said third end;

a second filter positioned in said interior of said service cartridge proximate said fourth end; and a desiccant interposed between said first and second filters.

13. A receiver for a condenser system, said condenser system including two spaced apart headers, and said receiver comprising:

a body configured for fluid communication with one of said spaced apart headers, said body having first and second ends;

a first cap coupled to said body at said first end and having a first saddle portion adapted for coupling to said one of said spaced apart headers;

a tube section coupled to said body at said second end;

a service cartridge being inserted through said tube section into an interior cavity of said body, said service cartridge including:

a substantially-rigid tubular member having third and fourth ends;

a cover at said third end; and a spindle extending from said cover for retention in a socket of said second cap; and a second cap removably interconnected with said tube section following insertion of said service cartridge into said interior cavity.

14. A receiver as claimed in claim 13 wherein said second cap comprises an inward surface, and said socket includes a flared region at said inward surface.

15. A receiver for a condenser system, said condenser system including two spaced apart headers, and said receiver comprising:

a body configured for fluid communication with one of said spaced apart headers, said body having first and second ends;

a first cap coupled to said body at said first end and having a first saddle portion adapted for coupling to said one of said spaced apart headers;

a tube section coupled to said body at said second end;

a service cartridge being inserted through said tube section into an interior cavity of said body, said service cartridge including:

a substantially-rigid tubular member having third and fourth ends;

a cover at said fourth end; and a spindle extending from said cover and abutting said first cap; and a second cap removably interconnected with said tube section following insertion of said service cartridge into said interior cavity.

16. A service cartridge for a receiver in a condenser system, said receiver having a body configured for fluid communication with a header of said condenser system, and a removably attachable cap for accessing an interior cavity of said body, said service cartridge insertable into said interior cavity, and said service cartridge comprising:

a substantially-rigid tubular member having first and second ends;

rib members radially extending from an outer surface of said substantially-rigid tubular member and configured to abut an inner surface of said tubular member;

a first cover at said first end and having a first opening extending through said first cover for receiving a refrigerant; and a second cover at said second end and having a second opening extending through said cover for discharging said refrigerant.

17. A service cartridge as claimed in claim 16 further comprising a spindle extending from said first cover adapted for retention in a socket region in said removably attachable cap.

18. A service cartridge as claimed in claim 16 wherein said receiver further includes a second cap on an opposite end of said body from said removably attachable cap, and said service cartridge further includes a spindle extending from said second cover, said spindle being configured to abut an inner surface of said second cap.

19. A service cartridge as claimed in claim 16 further comprising:

a first filter positioned in an interior of said service cartridge proximate said first end; and a second filter positioned in said interior of said service cartridge proximate said second end.

20. A service cartridge as claimed in claim 19 further comprising a desiccant interposed between said first and second filters.

21. A receiver for a condenser system, said condenser system including two spaced apart headers, and said receiver comprising:

a body configured for fluid communication with one of said spaced apart headers, said body having first and second ends;

a first cap coupled to said body at said first end and having a first saddle portion adapted for coupling to said one of said spaced apart headers;

a tube section coupled to said body at said second end;

a service cartridge inserted through said tube section into an interior cavity of said body, said service cartridge including a substantially-rigid tubular member having third and fourth ends, a first cover at said third end and having a first opening extending through said first cover, and a second cover at said fourth end and having a second opening extending through said second cover;

a second cap removably interconnected with said tube section following insertion of said service cartridge into said interior cavity;

means for separating said body of said receiver into a first chamber and a second chamber, said first cover being positioned in said first chamber, and said second cover being positioned in said second chamber;

an inlet aperture extending through said body into said first chamber; and an outlet aperture extending through said body into said second chamber.

22. A receiver as claimed in claim 21 wherein said separating means comprises a sleeve coupled about said service cartridge and extending from an outer surface of said service cartridge to abut an inner surface of said body.

23. A receiver as claimed in claim 21 wherein said first cover comprises a spindle extending from said first cover for retention in a socket region in said second cap.

24. A receiver as claimed in claim 23 wherein said spindle is a first spindle, said socket region is a first socket region, and said second cover comprises a second spindle extending from said second cover for retention in a second socket region in said first cap.

* * * * *